US010393138B2

(12) United States Patent
Gebert et al.

(10) Patent No.: US 10,393,138 B2
(45) Date of Patent: Aug. 27, 2019

(54) BLADE

(71) Applicants: Daniel Gebert, Öhringen (DE); Thorsten Pissarczyk, Gemmingen (DE); Oliver Haaf, Kupferzell (DE); Erhard Gruber, Satteldorf (DE)

(72) Inventors: Daniel Gebert, Öhringen (DE); Thorsten Pissarczyk, Gemmingen (DE); Oliver Haaf, Kupferzell (DE); Erhard Gruber, Satteldorf (DE)

(73) Assignee: EMB-PAPST MULFINGEN GmbH & CO KG (DE)

( * ) Notice: Subject to any disclaimer, the term of this patent is extended or adjusted under 35 U.S.C. 154(b) by 182 days.

(21) Appl. No.: 14/956,835

(22) Filed: Dec. 2, 2015

(65) Prior Publication Data

US 2016/0177968 A1 Jun. 23, 2016

(30) Foreign Application Priority Data

Dec. 17, 2014 (DE) ..... 10 2014 226 220
Jan. 13, 2015 (DE) ..... 10 2015 200 361

(51) Int. Cl.
*F04D 29/68* (2006.01)
*F04D 29/38* (2006.01)

(52) U.S. Cl.
CPC ..... *F04D 29/384* (2013.01); *F04D 29/681* (2013.01); *F05D 2240/305* (2013.01); *F05D 2240/306* (2013.01); *F05D 2250/182* (2013.01); *F05D 2250/183* (2013.01); *F05D 2250/185* (2013.01)

(58) Field of Classification Search
CPC ..... F04D 29/384; F04D 29/38; F04D 29/325
See application file for complete search history.

(56) References Cited

U.S. PATENT DOCUMENTS 5,066,196 A 11/1991 Morofushi
6,280,144 B1 * 8/2001 Powers ..... B63H 1/26 416/228
2004/0013526 A1 1/2004 Nilson

FOREIGN PATENT DOCUMENTS

JP 2008184999 * 8/2008

* cited by examiner

*Primary Examiner* — Woody A Lee, Jr.
*Assistant Examiner* — Sabbir Hasan
(74) *Attorney, Agent, or Firm* — Tarolli, Sundheim, Covell & Tummino LLP

(57) ABSTRACT

The invention relates to a blade for a fan impeller. In particular, the invention relates to the geometric configuration of the blade in its end area facing a hub. Furthermore, the invention relates to a fan impeller. A blade according to the invention for a fan impeller has an end area facing a hub, whereby the blade has at least one rib in the end area facing the hub, whereby the rib has an outer contour that simulates a flow profile.

14 Claims, 8 Drawing Sheets

BLADE

DESCRIPTION

Figure 1:
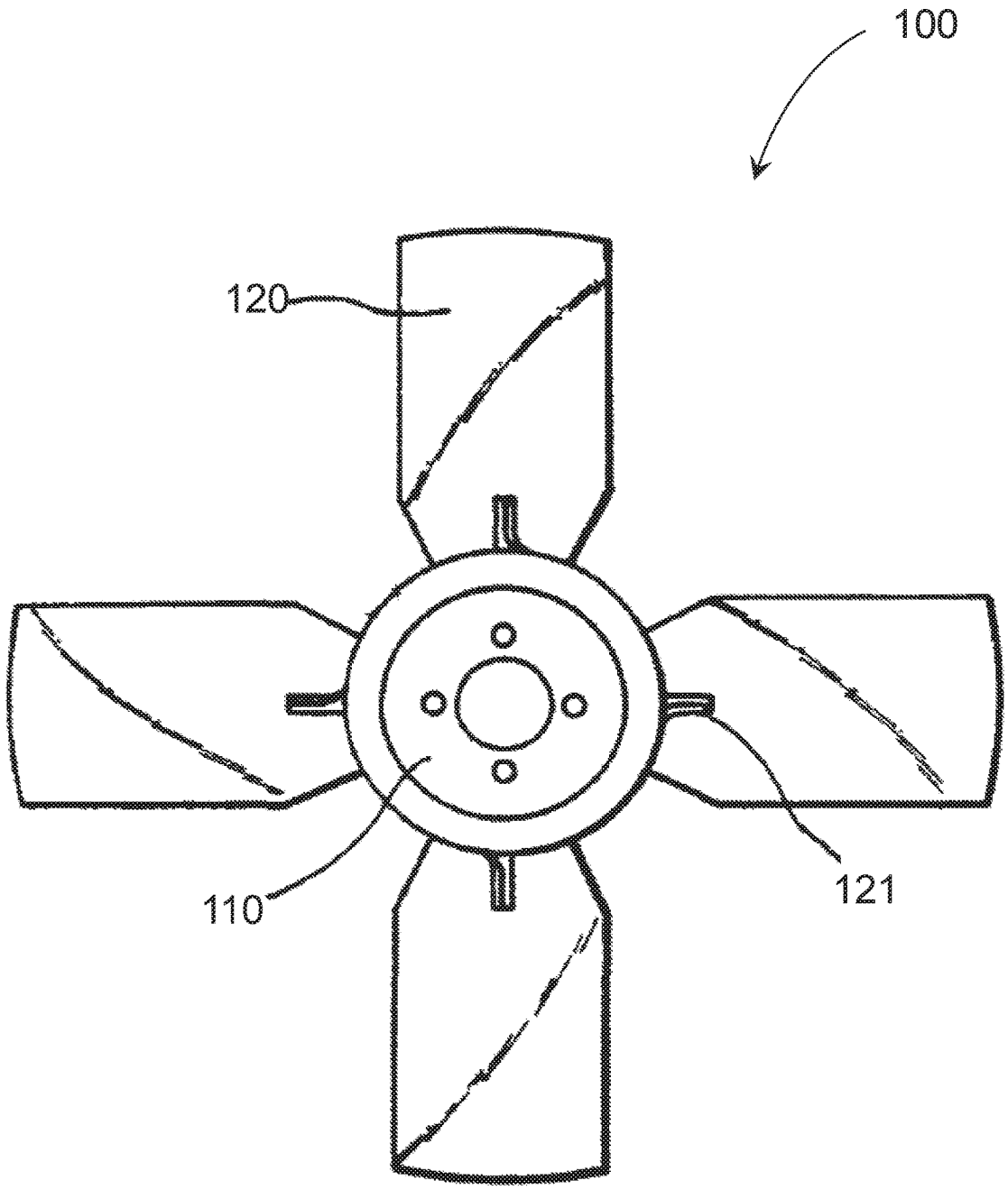

The invention relates to a blade for a fan impeller. In particular, the invention relates to the geometric configuration of the blade in its end area facing a hub. Furthermore, the invention relates to a fan impeller.

In the case of axial fans, the axis of rotation of the impeller runs parallel or axial to the air flow. In the case of radial fans, the axis of rotation of the impeller runs radially to the air flow on the outlet side. An impeller with blades rotates around a hub, thereby transporting a gaseous medium. Particularly during the production and/or installation of the fan wheel module in a device or the like, severe stresses occur that can damage the blades. During the operation of the fan impeller, the flow of the gaseous medium around the fan wheel blades gives rise to forces that have to be dissipated via the fan wheel hub into a shaft to which the fan wheel hub is attached, whereby the fan impeller stresses due to centrifugal forces are problematic.

Solutions to solve this problem are disclosed in the state of the art. For example, it is a known approach to increase the wall thickness of the blades in the area where the blades are connected to the hub. With this approach, however, the mass of the fan wheel is increased, which leads to higher production costs due to the fact that more material is needed. Fan wheels are normally made of plastic, and a greater wall thickness increases the cycle time for the production of the impeller, since, for example, the wall thickness has a quadratic effect on the cooling time of thermoplastic injection molding.

Another known approach for stiffening the blades in this area is to provide a bead in the cross section of the blade. This can also be provided in order to increase the wall thickness. Moreover, U.S. Pat. No. 5,066,196, for instance, proposes providing at least one reinforcing rib on the blade in the area where the blade is connected to the hub. By the same token, U.S. Pat. Appln. 2004/0013526 A1 proposes providing at least two ribs in the appertaining area of a blade of a fan wheel.

These reinforcement options, however, have negative effects on the flow. The efficiency and operating noise are detrimentally affected by the flow separation in the hub area. Moreover, when the axis of rotation is in a vertical position, liquid cannot drain completely, especially when the axial fan impeller is at a standstill. Water accumulations on the blades of fan wheels cause unbalances and icing damage, especially in the winter.

The objective of the invention is to put forward a blade for a fan impeller that has optimized properties in terms of the strength requirements, material use and ease of production, while at least retaining the flow properties, and without incurring technical compromises in terms of noise and efficiency.

According to the invention, this objective is achieved by a blade for a fan impeller having the features of the independent claim 1.

Advantageous refinements of the blade can be gleaned from the subordinate claims 2 to 15.

Another objective of the invention lies in putting forward a fan impeller that has optimized properties in terms of the strength requirements, material consumption and ease of production, while at least retaining the flow properties, and without incurring technical compromises in terms of noise and efficiency.

This additional objective is achieved according to the invention by a fan impeller having the features of the alternative independent claim 16. Advantageous refinements of the fan impeller can be gleaned from the subordinate claims 17 and 18.

A blade according to the invention for a fan impeller has an end area facing a hub, whereby the blade has at least one rib in the end area facing the hub, whereby the rib has an outer contour that simulates a flow profile. In this context, the term flow profile refers to the shape of the blade cross section due to whose specific blade shape and due to the flowing of a gas gives rise to forces that attack the element. This can be, for example, a planar-convex profile with a convex first blade side and a planar second blade side, or else it can be a concave-convex profile with a convex first blade side and a concave second blade side. Here, the blade cross section forms an outer contour, whereby in the area of the ribs, the envelope forms the delineation of the outer contour.

The invention is based on the surprising realization that the ribs do not have a negative effect on the flow along the blades when the outer contour of the ribs simulate a flow profile, even though the turbulence level is increased by the ribs and the blade profile over which the medium flows is interrupted. This effect remains, even when the blade profile over which the medium flows is interrupted multiple times by several ribs on a blade. Nevertheless, the ribs have a reinforcing effect. Consequently, the blade according to the invention has optimized strength properties, while at least retaining flow properties, and without incurring technical compromises in terms of noise and efficiency, whereby the wall thickness of the blade was not increased and thus no negative effects are encountered in terms of the material consumption and ease of production.

In an advantageous embodiment of the blade according to the invention, the ratio of the maximum wall thickness of the blade to the maximum profile thickness of the blade is between 0.1 and 0.9, whereby a ratio of 0.2 to 0.6 is particularly preferred.

Moreover, it has proven to be advantageous if the ratio of the thickness of the rib to the wall thickness of the blade is in the range from 0.1 to 2, especially preferably in the range from 0.5 to 1.5.

In another preferred embodiment of the blade according to the invention, at the shoulder leading to the hub, the rib has an angle relative to the radial direction in the range between −80° and +80°, especially preferably between −45° and +45°.

The further course of the rib can be configured to be rectilinear. As an alternative, however, it can also be configured to be curved counterclockwise to the left of the radial direction or else it can be configured to be curved clockwise to the right of the radial direction.

In another advantageous embodiment of the blade according to the invention, the rib has an end geometry in the area of the outer contour, whereby the end geometry of the rib creates a saw-tooth profile, whereby the end geometry of the rib forms an angle in the range from −45° to +45°, especially preferably from −30° to +30° relative to the outer contour. With such a saw-tooth profile, the flow that separates at the end of the rib does not flow over a protruding edge of the rib.

Moreover, it has proven to be advantageous for the blade to have at least two ribs in the end area facing the hub, whereby the ratio of the gap between two ribs to the thickness of one rib is in the range from 0.2. to 5, preferably in the range from 0.5 to 1.5. Here, all of the ribs of a blade can have the same thickness and, by the same token, the gaps between several or all of the ribs of a blade can have the same dimension. However, the dimensions of the individual ribs and gaps can also differ from each other.

Another advantageous embodiment of the blade according to the invention is characterized in that the rib base at the starting point of the rib in the end area facing the hub is situated higher in the axial direction than the opposite rib base at the end point of the rib. As a result, this rib base at the end point of the rib in the direction of flow is situated lower than the rib base at the starting point of the rib in the end area facing the hub. Consequently, any water that might strike a blade of a stationary fan impeller can drain off, especially if the fan impeller is configured with an essentially vertical orientation of the axis of rotation, as a result of which, even at ambient temperatures below the freezing point, icing is ruled out and therefore, no unbalances and/or icing damage can occur.

A fan impeller according to the invention has at least one blade according to the invention. Here, the fan impeller can be an axial fan impeller, a radial fan impeller or an impeller of a different fan design. In this context, the term fan should not be understood in a limiting manner, but rather, encompasses ventilators, blowers as well as also, for instance, rotors and propellers, so that the invention also extends to blades and fan impellers found in all kinds of areas of application.

Additional advantages, special features and advantageous refinements of the invention can be gleaned from the subordinate claims and from the presentation below of preferred embodiments with reference to the figures. The depicted embodiments are the blade of an axial fan impeller, although this should not be construed in a limiting manner. The elaborations can also be applied to radial fan impellers or other fan impeller designs.

Figure 2:
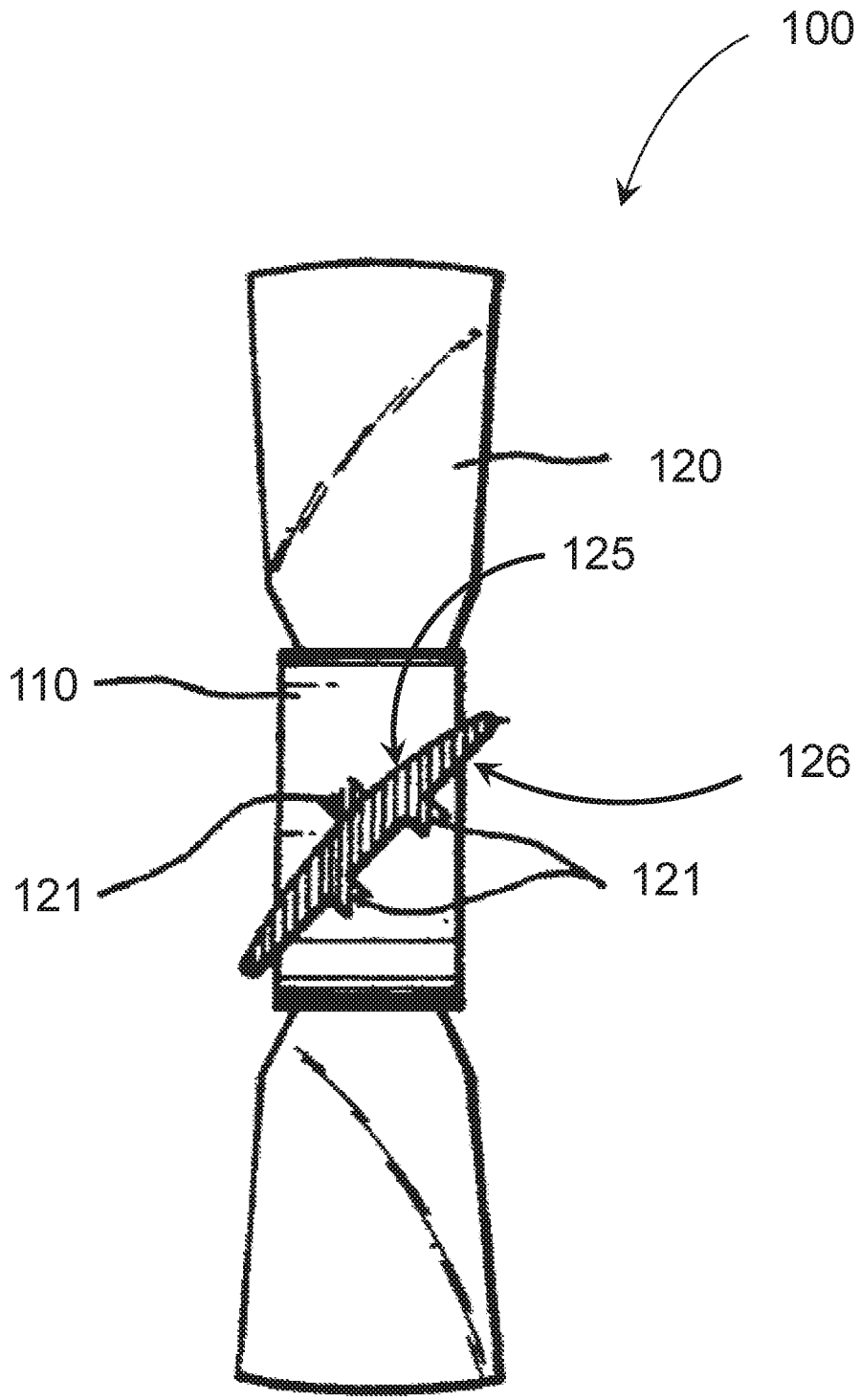
Figure 3:
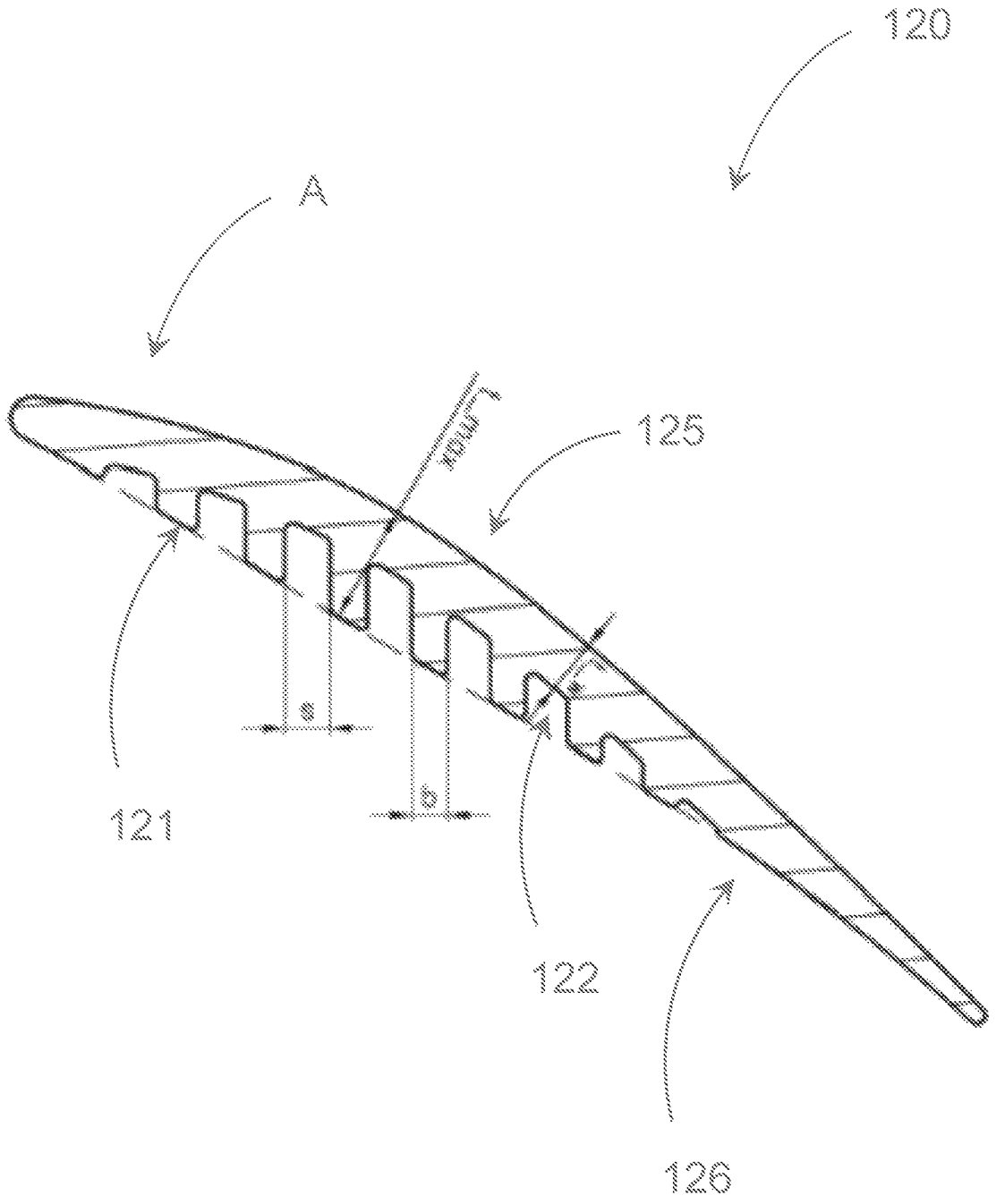
Figure 4:
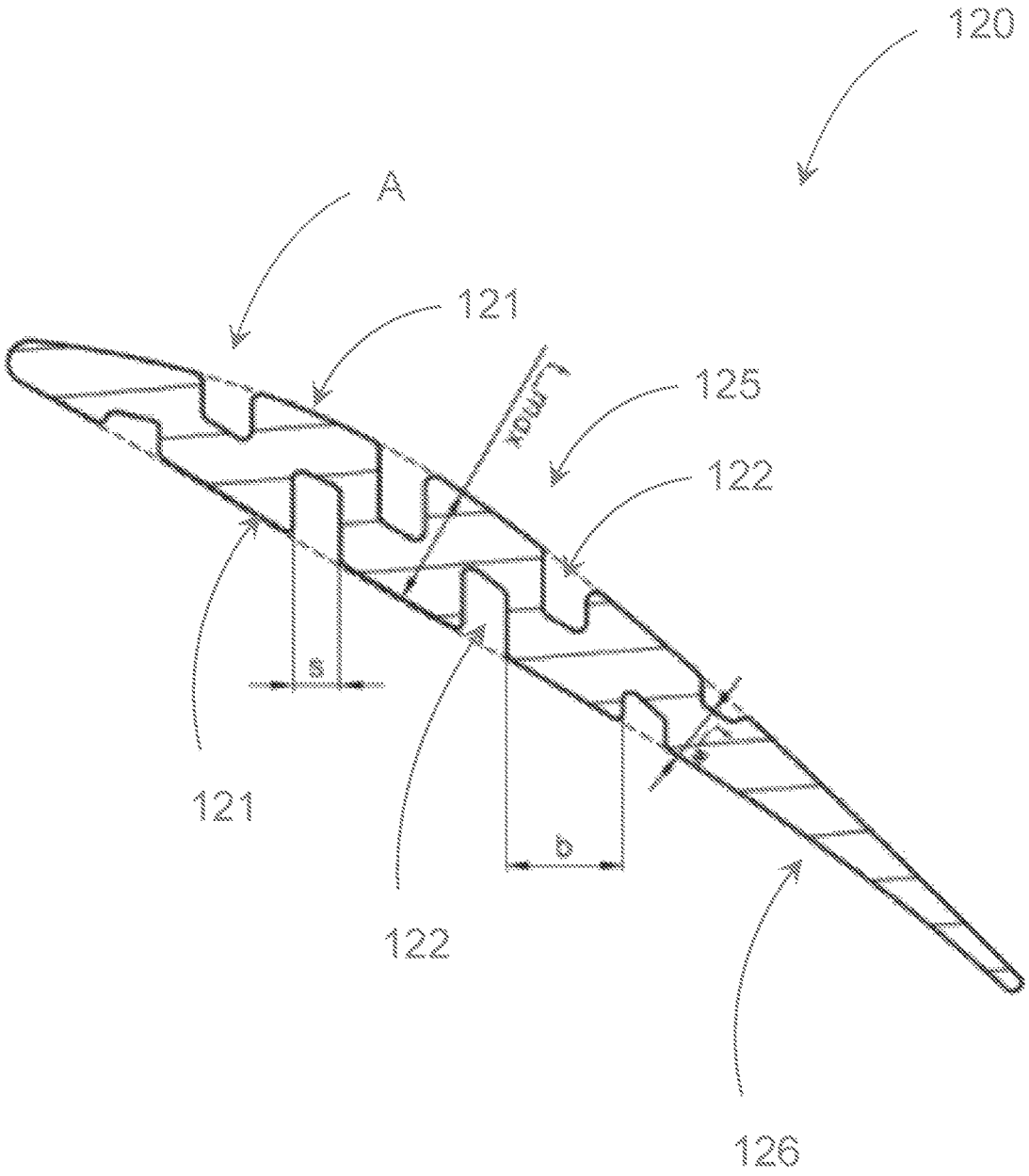
Figure 5:
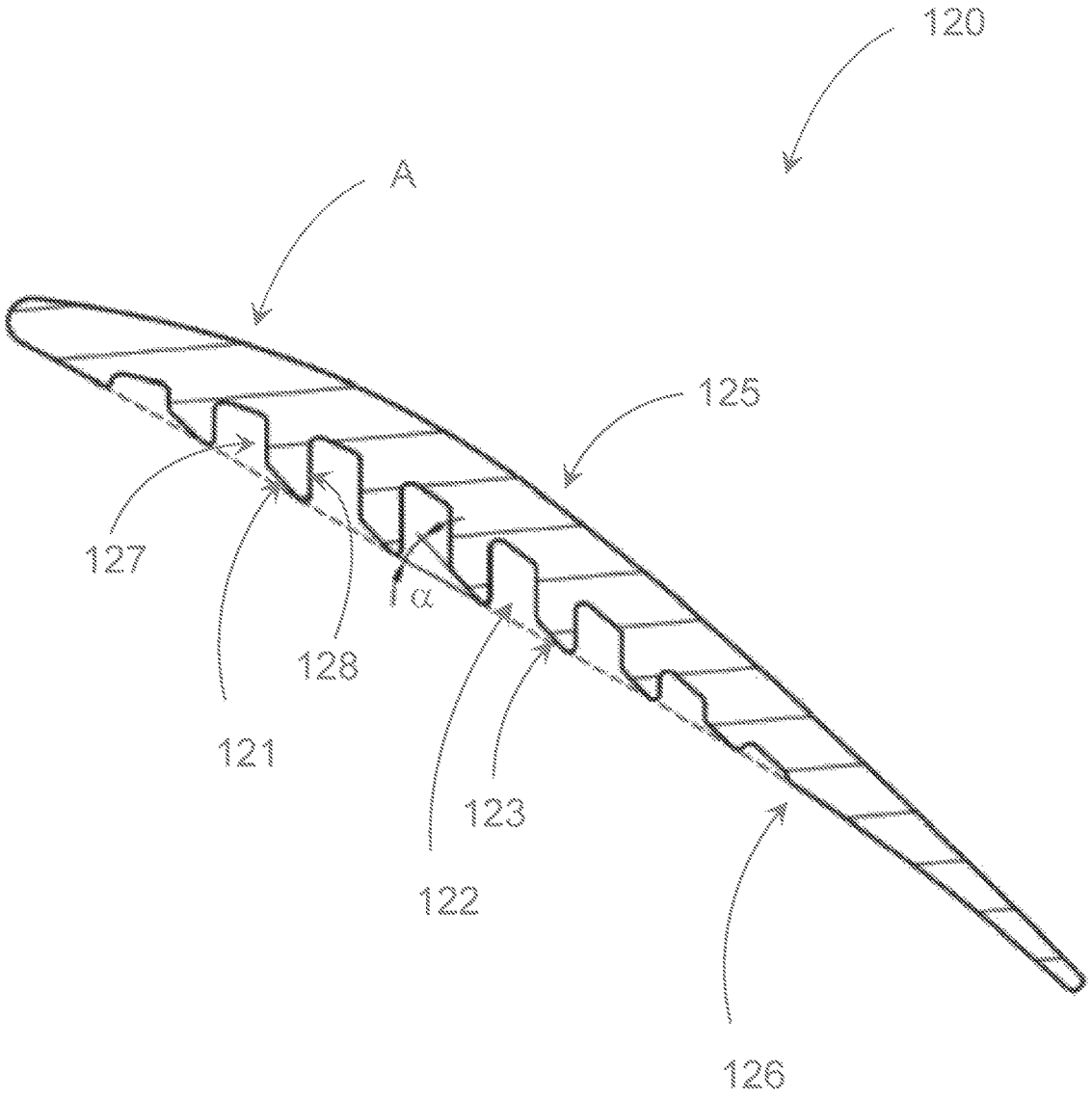
Figure 6:
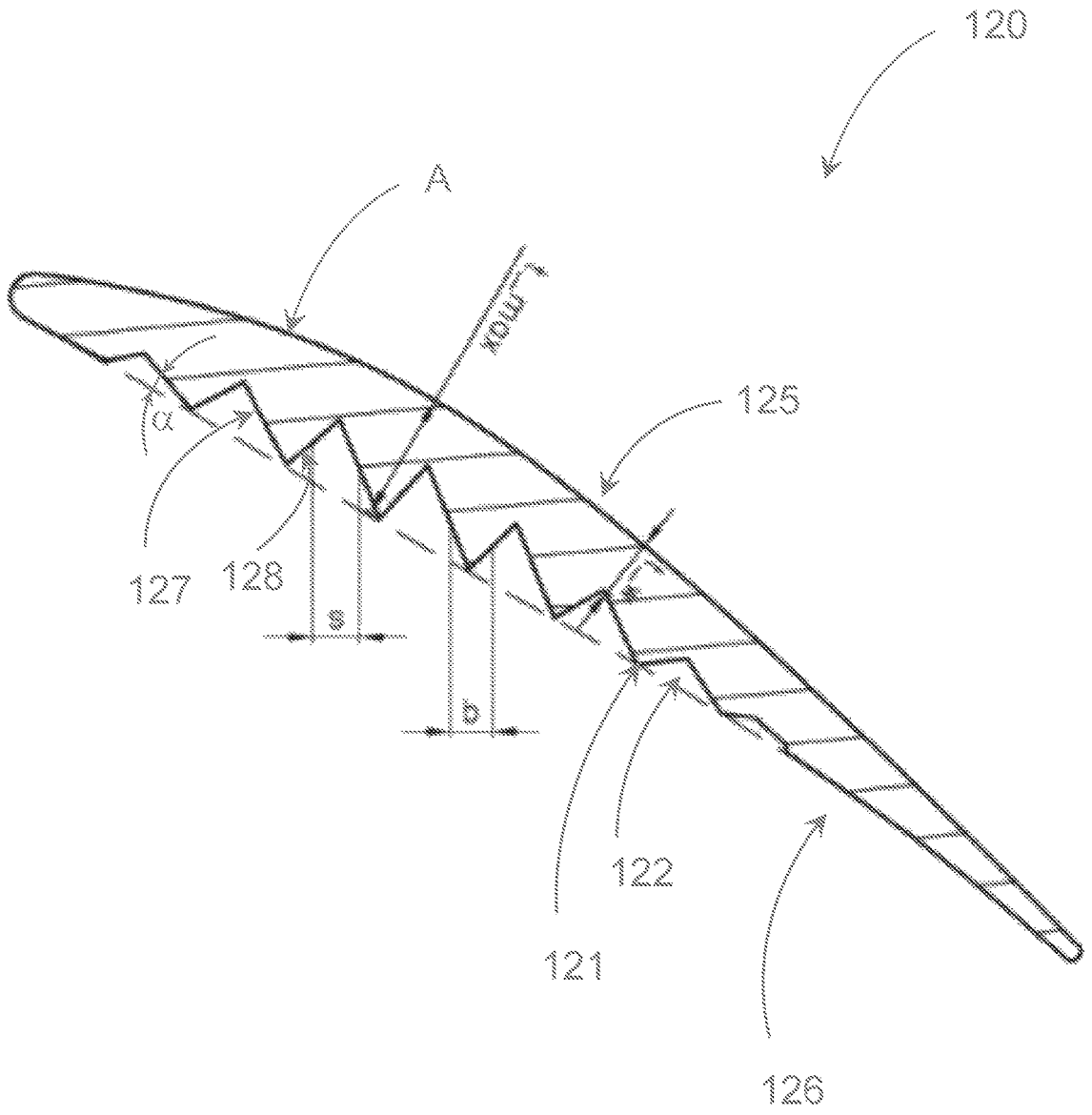
Figure 7:
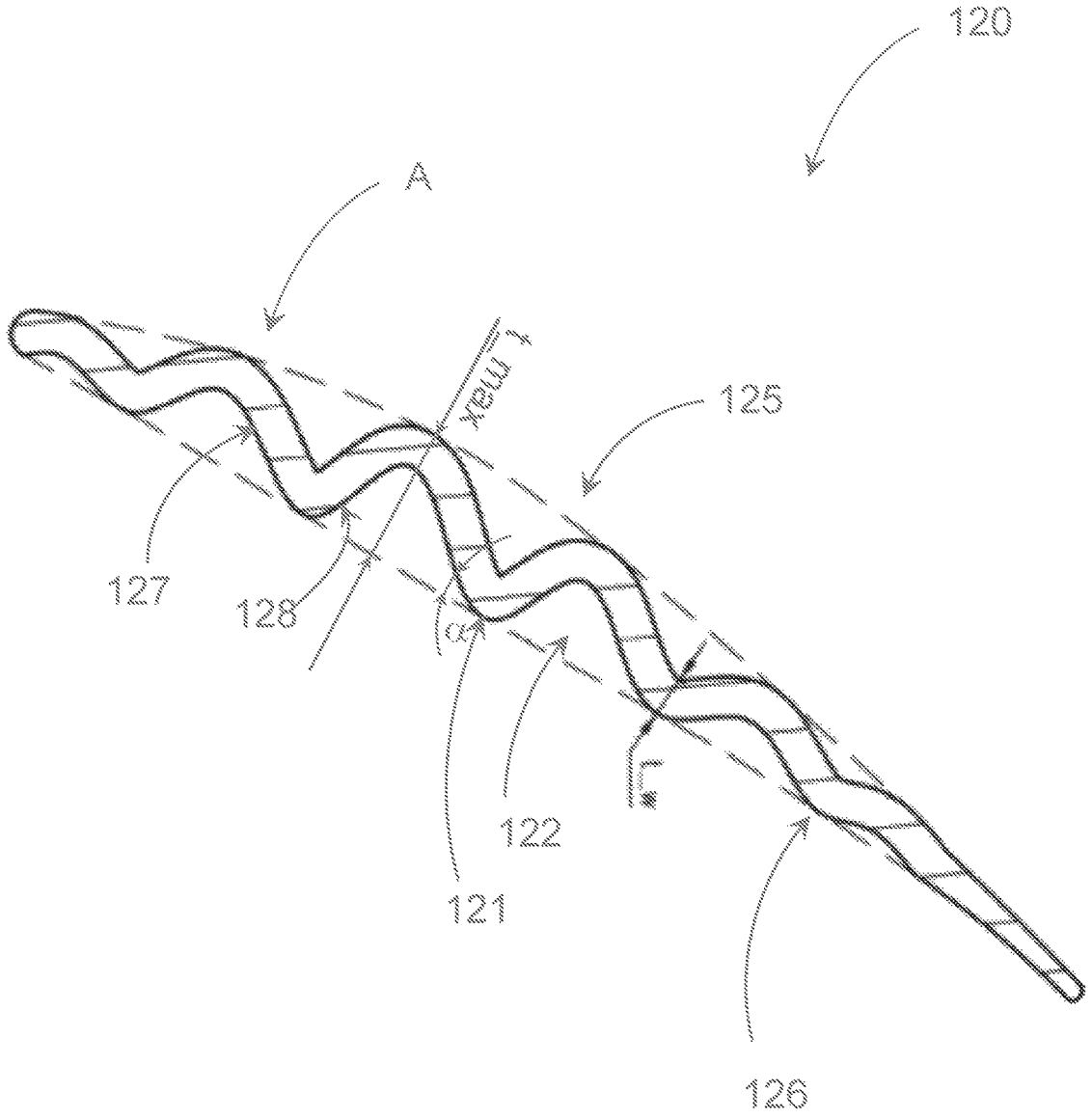
Figure 8:
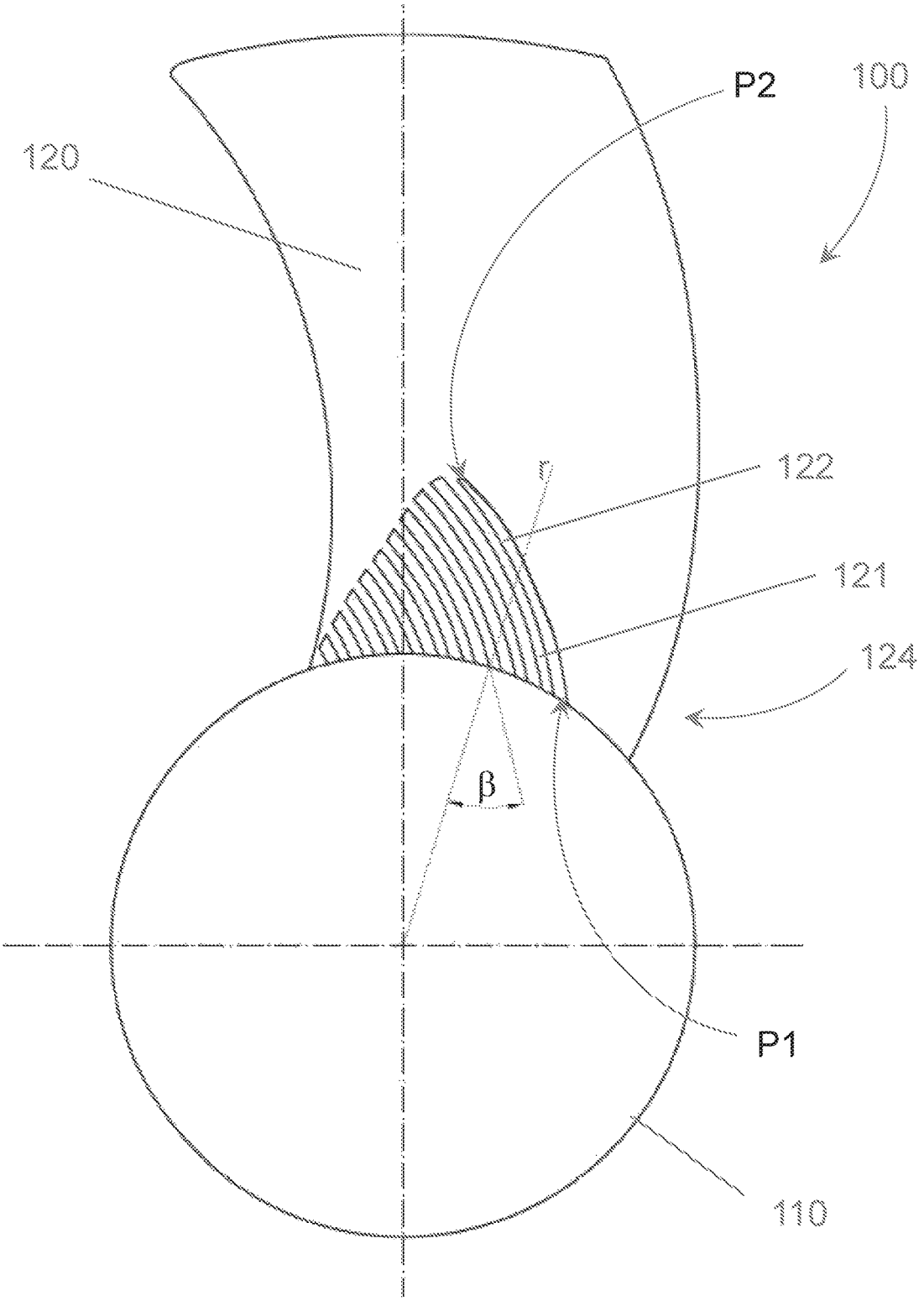

The figures show the following:

FIG. 1 an axial fan impeller according to the state of the art, in a top view;

FIG. 2 the axial fan impeller according to the state of the art, in a cross sectional view;

FIG. 3 a first embodiment of a fan wheel blade of an axial fan impeller according to the invention, in a sectional view;

FIG. 4 a second embodiment of a fan wheel blade of an axial fan impeller according to the invention, in a sectional view;

FIG. 5 a third embodiment of a fan wheel blade of an axial fan impeller according to the invention, in a sectional view;

FIG. 6 a fourth embodiment of a fan wheel blade of an axial fan impeller according to the invention, in a sectional view;

FIG. 7 a fifth embodiment of a fan wheel blade of an axial fan impeller according to the invention, in a sectional view;

FIG. 8 a partial top view of an axial fan impeller according to the invention.

FIG. 1 shows a fan impeller 100 according to the state of the art. Four fan wheel blades 120 are installed on a hub 110. Each fan wheel blade 120 has a rib 121 in the area where it is connected to the hub 110, whereby the rib 121 is likewise shaped onto the hub 110 and is placed onto the fan wheel blade 120. The forces that arise on the fan wheel blade 120 due to centrifugal forces are dissipated not only via the connection to the fan wheel blade 120, but additionally via the rib 121 into the hub 110.

FIG. 2 shows the same fan impeller 100 of FIG. 1 in a partial cross section. Here, a fan wheel blade 120 is shown in a sectional view in the area where it is connected to the hub 110. The flow profile of the fan wheel blade 120 has a convexly curved first blade side 125 and a planar second blade side 126. A rib 121 is provided on the first blade side 125 while two ribs 121 are located on the second blade side 126. The ribs 121 are placed onto the blade sides 125, 126, thereby interrupting the flow profile, which leads to a worse efficiency in terms of the flow as well as to increased noise emissions during the operation of the axial fan impeller.

FIG. 3 shows a first embodiment of a fan wheel blade 120 of an axial fan impeller 100 according to the invention in a cross sectional view. The outer contour A has a convexly shaped first blade side 125 and a slightly concave-shaped second blade side 126. In other words, the flow profile of the fan wheel blade 120 has a concave-convex shape. On the second blade side 126, there are seven ribs 121 with gaps 122 arranged between them. The maximum wall thickness t_w as well as the maximum profile thickness t_max of the fan wheel blade 120 are also shown, whereby the ratio of t_w to t_max is approximately 0.5. The thickness b of a rib 121 is also shown, whereby the ratio of b to t_w is approximately 0.63. In addition, the width s of the gap 122 between two ribs 121 is shown in FIG. 3. Here, the ratio of s to b amounts to approximately 1.25. With the indicated geometry ratios, the ribs 121 form an outer contour A that simulates a flow profile.

FIG. 4 shows a second embodiment of a fan wheel blade 120 of an axial fan impeller 100 according to the invention in a cross sectional view. In this embodiment as well, the outer contour A has a convex-shaped first blade side 125 and a slightly concave-shaped second blade side 126. On the second blade side 126, there are three ribs 121 with gaps 122 arranged between them. Moreover, the first blade side 125 likewise has three ribs 121 with gaps 122 arranged between them. In FIG. 4, the maximum wall thickness t_w as well as the maximum profile thickness t_max of the fan wheel blade 120 are shown, whereby the ratio of t_w to t_max is approximately 0.4. Furthermore, the thickness b of a rib 121 is shown, whereby the ratio of b to t_w is approximately 1.5. In addition, in FIG. 4, the width s of the gap 122 between two ribs 121 is also shown. Here, the ratio of s to b amounts to approximately 0.5. With these indicated geometry ratios as well, the ribs 121 form an outer contour A that simulates a flow profile.

FIG. 5 shows a third embodiment of a fan wheel blade 120 of an axial fan impeller 100 according to the invention, in a cross sectional view. In this embodiment as well, the outer contour A has a convex-shaped first blade side 125 and a slightly concave-shaped second blade side 126. As in the first embodiment of FIG. 3, on the second blade side 126, there are seven ribs 121 with gaps 122 arranged between them. The ribs 121 have first rib flanks 127 and second rib flanks 128 as well as an end geometry 123 at the rib heads. The end geometries 123 form a saw-tooth profile, whereby the end geometries 123 of the ribs 121 form an angle $\alpha$ of approximately 30° relative to the outer contour A, that is to say, here relative to the tangent on the surface contour of the second blade side 126. In this embodiment as well, the ribs 121 form an outer contour A that simulates a flow profile. With such a saw-tooth profile, the flow that separates at the end of the rib does not flow over a protruding edge of the rib 121, thereby contributing to increasing the efficiency and minimizing the operating noise.

FIG. 6 shows a fourth embodiment of a fan wheel blade 120 of an axial fan impeller 100 according to the invention, in a cross sectional view. In this embodiment as well, the outer contour A has a convex-shaped first blade side 125 and a slightly concave-shaped second blade side 126. As in the first embodiment of FIG. 3 or in the third embodiment of FIG. 5, on the second blade side 126, there are seven ribs 121 with gaps 122 arranged between them. The ribs 121 have a first rib flank 127 and a second rib flank 128, whereby the rib flanks 127, 128 converge at the rib head and form a saw-tooth profile. Here, the first rib flanks form an angle α of approximately 30° relative to the outer contour A, that is to say, here relative to the tangent on the surface contour of the second blade side 126. In this embodiment as well, the ratio of the wall thickness t_w of the fan wheel blade 120 to the maximum profile thickness t_max of the fan wheel blade 120, namely, approximately 0.5, is in the especially preferred range of 0.2 to 0.6. Furthermore, the ratio of the thickness b of a rib 121 to the wall thickness t_w of the fan wheel blade 120, namely, about 0.8 in this embodiment, is in the especially preferred range of 0.5 to 1.5. Moreover, the ratio of the width s of the gap 122 between two ribs 121 to the thickness b of a rib 121, namely, approximately 1.0, is in the especially preferred range of 0.5 to 1.5. In this embodiment as well, the ribs 121 form an outer contour A that simulates a flow profile. With this saw-tooth profile as well, the flow that separates at the end of the rib does not flow over a protruding edge of the rib 121, thereby contributing to increasing the efficiency and minimizing the operating noise.

FIG. 7 shows a fifth embodiment of a fan wheel blade 120 of an axial fan impeller 100 according to the invention, in a cross sectional view. The fan wheel blade consists of a profile configured with a corrugated shape, whereby the corrugated shape forms an outer contour A in the form of an envelope, and the outer contour likewise forms a flow cross section. Here, the corrugations of the profiles can be interpreted as ribs 121 and as gaps 122 arranged between them, whereby the indicated geometry ratios are also adhered to in this embodiment.

Finally, FIG. 8 shows a partial top view of an axial fan impeller 100 according to the invention. Only one fan wheel blade 120 is shown, whereby there can be several fan wheel blades 120, for instance, four fan wheel blades 120, on the hub 110. In the top view, nine ribs 121 can be seen on the fan wheel blade 120, whereby there are ten gaps 122 between the ribs 121. The ribs 121 form an angle β of approximately 45° relative to the radial direction r on the shoulder of the fan wheel blade 120 leading to the hub 110. The ribs 121 continue away from the hub 110 counterclockwise to the left, and are curved away from the radial direction. The rib base P1 at the starting point of the rib 121 where the fan when blade 120 is connected to the hub 110 is arranged higher in the axial direction of the axial fan wheel 120 than the opposite rib base P2 at the end point of the rib 121. As a result, the rib base P1 at the end point of the rib 121 as seen in the direction of flow is lower than the rib base P2 at the starting point of the rib 121 where the fan wheel blade 120 is connected to the hub 110. Consequently, any water that might strike the stationary axial fan wheel blade 120 can drain off, especially if the axial fan wheel blade 120 is configured with an essentially vertical orientation of the axis of rotation, as a result of which, even at ambient temperatures below the freezing point, icing is ruled out and therefore, no unbalances and/or icing damage can occur.

The embodiments presented here constitute merely examples of the present invention and thus must not be construed in a limiting fashion. Alternative embodiments taken into consideration by the person skilled in the art are equally encompassed by the scope of protection of the present invention.

LIST OF REFERENCE NUMERALS

100 fan impeller
110 hub
120 blade
121 rib
122 gap
123 end geometry of the rib
124 end area of the blade facing the hub
125 first blade side
126 second blade side
127 first rib flank
128 second rib flank
A outer contour
P1 rib base at the starting point of the rib
P2 rib base at the end point of the rib
t_max maximum profile thickness
t_w wall thickness
b thickness of a rib
r radial direction
s width of the gap L
α slant (saw-tooth)
β angle of the ribs at the shoulder leading to the hub relative to the radial direction

The invention claimed is:

1. A blade for a fan impeller with an end area facing a hub, characterized in that the blade has at least one rib in the end area facing the hub, wherein the at least one rib has a starting point (P1) at a shoulder of the blade leading to the hub and extends away from the hub to an end point (P2), the at least one rib having an outer contour (A) that extends from the starting point (P1) to the end point (P2), wherein the outer contour (A) simulates a flow profile and forms an angle (3) between −45° and +45° with respect to a radial direction of the shoulder, wherein the ratio of the maximum wall thickness (tw) of the blade to the maximum profile thickness (tmax) of the blade is in the range from 0.1 to 0.9, wherein the at least one rib has an end geometry in an area of the outer contour (A), wherein the end geometry creates a saw-tooth profile, and wherein the end geometry of the at least one rib forms an angle (a) in the range from −1° to +45° or from 10 to 450 relative to the outer contour (A).

2. The blade according to claim 1, characterized in that the ratio of the maximum wall thickness (t_w) of the blade to the maximum profile thickness (t_max) of the blade is in the range from 0.2 to 0.6.

3. The blade according to claim 1, characterized in that the ratio of the thickness (b) of the at least one rib to the wall thickness (t_w) of the blade is in the range 0.1 to 2.

4. The blade according to claim 3, characterized in that the ratio of the thickness (b) of the at least one rib to the wall thickness (t_w) of the blade is in the range from 0.5 to 1.5.

5. The blade according to claim 1, characterized in that a further course of the at least one rib from the end area facing the hub is configured to be rectilinear.

6. The blade according to claim 1, characterized in that a further course of the at least one rib from the end area facing the hub is configured to be curved counterclockwise to the left of the radial direction (r).

7. The blade according to claim 1, characterized in that a further course of the at least one rib from the end area facing the hub is configured to be curved clockwise to the right of the radial direction (r).

8. The blade according to claim 1, characterized in that the end geometry of the at least one rib forms the angle (α) in the range from −1° to −30° or from 1° to +30° relative to the outer contour (A).

9. The blade according to claim 1, characterized in that the at least one rib includes a plurality of ribs, wherein between any two of the plurality of ribs, there is a gap and whereby the ratio of the width (s) of the gap to the thickness (b) of the at least one rib is in the range from 0.2 to 5.

10. The blade according to claim 9, characterized in that between any two of the plurality of ribs, there is a gap and whereby the ratio of the width(s) of the gap to the thickness (b) of one of the any two of the plurality of ribs is in the range from 0.5 to 1.5.

11. The blade according to claim 1, characterized in that the starting point (P1) of the at least one rib in the end area facing the hub where the blade is connected to the hub is situated closer to the hub on the blade higher in the axial direction than the end point (P2) of the at least one rib.

12. A fan impeller with a hub, characterized in that the fan impeller has at least one blade according to claim 1.

13. A fan impeller according to claim 12, characterized in that the fan impeller is an axial fan impeller.

14. A fan impeller according to claim 12, characterized in that the fan impeller is a radial fan impeller.

* * * * *